US006758157B2

(12) United States Patent
Grieger et al.

(10) Patent No.: US 6,758,157 B2
(45) Date of Patent: Jul. 6, 2004

(54) STREAMER CABLE CONNECTOR

(75) Inventors: Stephen L. Grieger, Needville, TX (US); James T. Burcham, Richmond, TX (US)

(73) Assignee: Concord Technologies, LP, Houston, TX (US)

( * ) Notice: Subject to any disclaimer, the term of this patent is extended or adjusted under 35 U.S.C. 154(b) by 0 days.

(21) Appl. No.: 10/459,915

(22) Filed: Jun. 11, 2003

(65) Prior Publication Data

US 2003/0226488 A1 Dec. 11, 2003

Related U.S. Application Data

(60) Provisional application No. 60/387,996, filed on Jun. 11, 2002.

(51) Int. Cl.[7] ..... B63B 21/66
(52) U.S. Cl. ..... 114/244
(58) Field of Search ..... 114/243, 244, 114/245; 367/15

(56) References Cited

U.S. PATENT DOCUMENTS

| | | | | |
|---|---|---|---|---|
| 3,675,193 A | * | 7/1972 | Davis | 367/15 |
| 4,290,124 A | | 9/1981 | Cole | 367/18 |
| 4,709,355 A | | 11/1987 | Woods et al. | 367/16 |
| 5,529,011 A | | 6/1996 | Williams, Jr. | 114/245 |

* cited by examiner

*Primary Examiner*—Ed Swinehart
(74) *Attorney, Agent, or Firm*—Gary L. Bush; Andrews Kurth LLP

(57) ABSTRACT

A streamer cable connector including a cylindrical inner race and an outer race with a cavity formed therein to capture the inner race. The outer race has leading and trailing fairings to minimize abrupt structural changes along the longitudinal length of the connector in order to minimize self-generated noise as the streamer cable is pulled through the water. The fairings are fabricated of compliant material so that the connector can be wound around a reel while under tension to inhibit damage to the inner race or to the cable itself.

4 Claims, 2 Drawing Sheets

FIG. 1
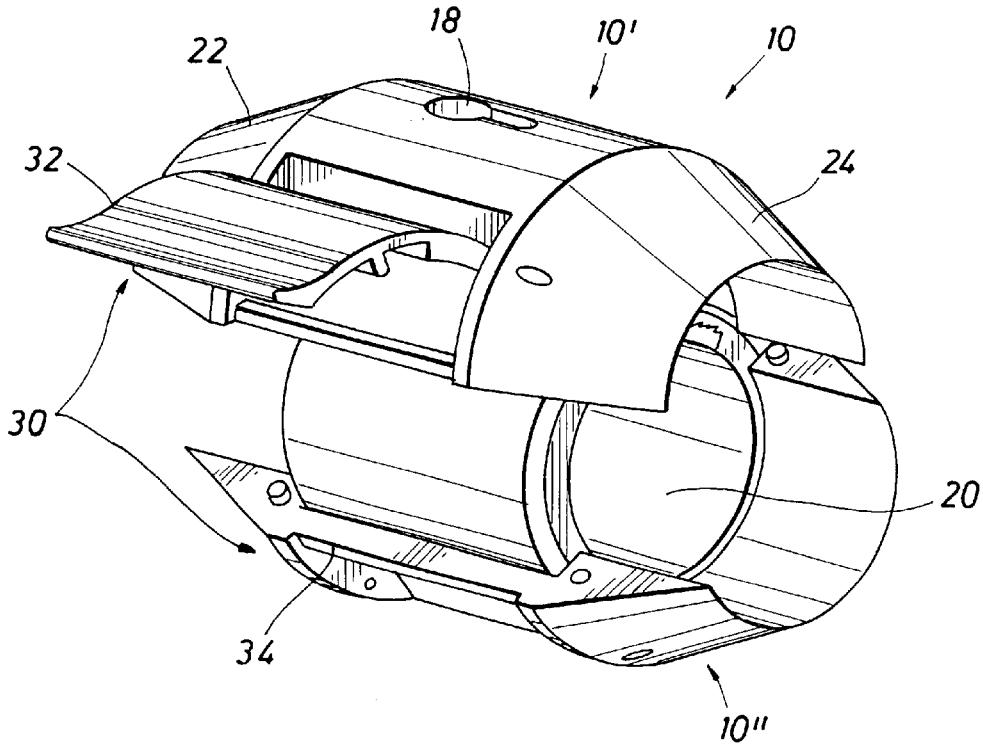
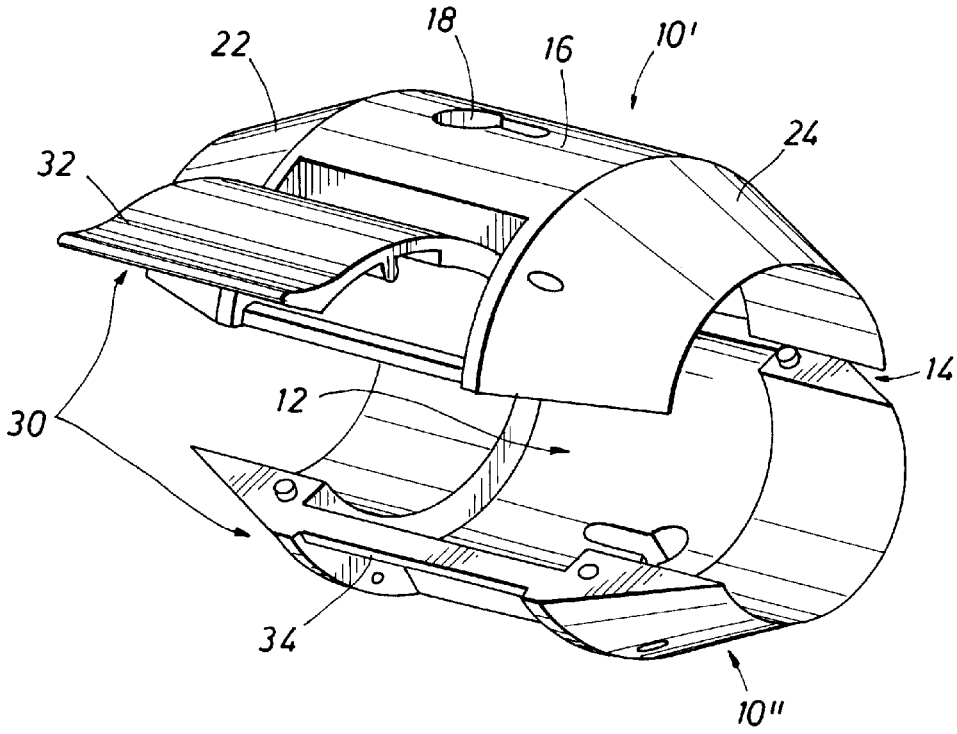
FIG. 2

STREAMER CABLE CONNECTOR

CROSS REFERENCE TO RELATED APPLICATION

This application is based upon provisional U.S. patent application No. 60/387,996 filed Jun. 11, 2002, the prior date of which is claimed.

BACKGROUND OF THE INVENTION

1. Field of the Invention

This invention relates generally to the field of auxiliary equipment for marine seismic cables and more particularly to the attachment of equipment to cables, and even more particularly to the shape and construction of the connector.

2. Description of the Prior Art

In the course of conducting marine seismic surveys for oil and gas, it is customary to tow cables, often 3 to 10 kilometers in length, beneath the surface and astern of a survey ship. As many as twelve of these cables are towed at one time. Each cable contains multiple hydrophones as well as associated electronics and other sensors required in the data acquisition process. The cables are called "streamers" and are constructed using semi-solid plastic material or oil filled flexible tubing. They are typically two to three inches in diameter.

When conducting seismic surveys, the depth of the cable must be maintained at a precise distance from the surface. This is accomplished by the use of depth control devices that are attached to the exterior of the streamer cable using collars which are secured around the cable and result in a bearing comprising an inner race and an outer race that allows the cable to be free to rotate within the attachment point. The outer race and inner race are constructed and assembled so that they can rotate with respect to each other. The outer race is attached to the depth control device. Other types of modules for other purposes are attached in the same manner.

As the cable is towed through the water, it is very important that self-generated noise be minimized, because the noise interferes with reception of the signals of interest. Any abrupt physical upset of the cylindrical shape of the cable produces turbulence, thereby creating unwanted noise. Also there is need to avoid damage to the streamer cable where the outer race remains on the cable during streamer windup on a reel.

Common practice and prior art is described in a number of patents such as:

- U.S. Pat. No. 4,290,124 Cole, Jimmy R. Remote Control Cable Depth Control Apparatus
- U.S. Pat. No. 4,709,355 Woods et al Controller for Marine Seismic Activity
- U.S. Pat. No. 5,529,011 Williams, Oneil J. Connector for Underwater Cables

OBJECTS OF THE INVENTION

A primary object of this invention is to provide an outer race for a collar that reduces self-generated noise when being towed through the water.

Another object of the invention is to construct an outer race which when left connected to a streamer cable and wound on a rotating storage reel, does minimal damage to the streamer cable beneath.

SUMMARY OF THE INVENTION

The objects identified above and other features and advantages of the invention are incorporated by providing an outer race that minimizes noise generation and prevents damage to the cable and to itself when pulled onto a survey vessel and wound on a reel. The outer race is a split and hinged device that can be placed around the inner race and latched in place. The outer race is constructed of two different types of plastic material. The central portion of the race is made of a strong rigid plastic material. The frustro-conical fairings that extend from each end of the outer race serve as fairings to minimize turbulence when the streamer is pulled through the water. The fairings are constructed of compliant plastic material. The soft fairings can be wound around a reel while under tension to inhibit damage to the inner race or to the cable itself.

DESCRIPTION OF THE DRAWINGS

FIG. 1 is a perspective drawing of a complete collar assembly;

FIG. 2 is a perspective drawing of the outer race according to the invention;

DESCRIPTION OF A PREFERRED EMBODIMENT OF THE INVENTION

Figure 3:
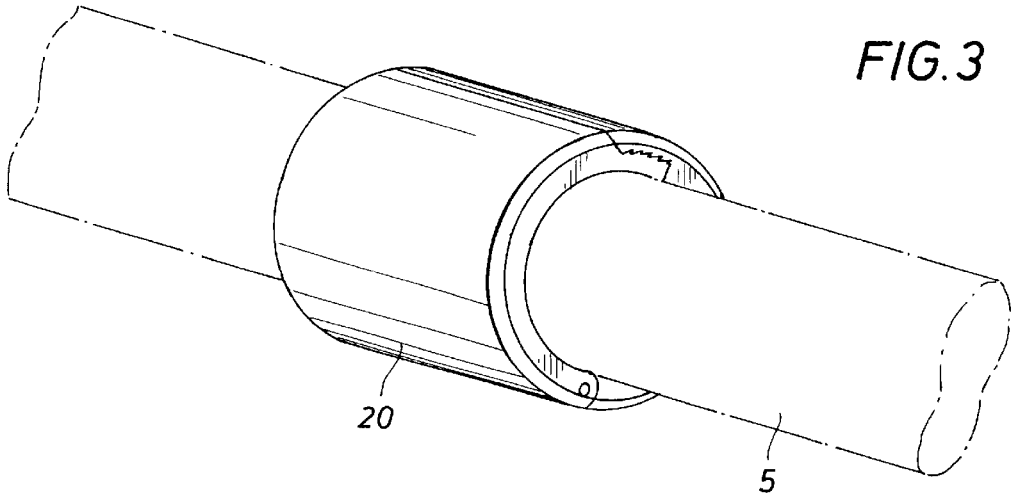
FIG. 3 is a perspective drawing of an inner race.

FIG. 1 shows an outer race 10 with an inner race 20 of FIG. 3 arranged and designed to be captured within a cavity 12 of the outer race 10 as best seen in FIG. 2. The outer race includes a hinge 14 along sides 10', 10" by which the two halves 10' and 10" of the outer race 10 can be opened for placement around the inner race 20. A latching mechanism 30 including a latch 32 and receiver 34 on the two halves 10', 10" of the outer race 10 allows removable securement of the two halves 10', 10" about the inner race 20.

Figure 4:
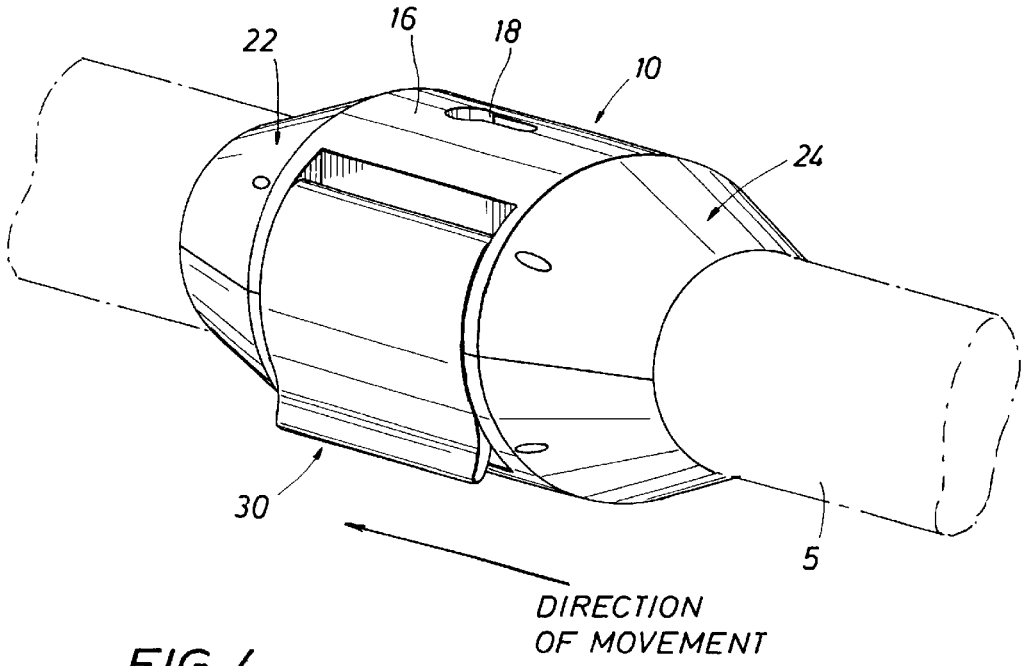
FIG. 4 shows a collar installed and secured to a cable.

FIG. 4 shows the latching mechanism 30 in a closed position where the inner race 20 of FIG. 3 has been removably secured about a streamer cable 5, and the outer race 10 has been removably secured about the inner race. The inner race 20 is described in copending U.S. patent application No. 10/460/109 filed on Jun. 11, 2003, and is incorporated by reference herein. The outer race 10 has a coupling slot 18 for attachment of a depth control device or other equipment.

According to the invention, the outer race 10 includes leading and trailing fairings 22, 24 of a generally frustro-conical shape in order to provide a relatively smooth transition between the outer diameter of the streamer cable 5 and the outer diameter of the central section 16. The fairings 22, 24 are secured to the central section 16 by fasteners such as screws but alternatively can be integrated thereby by molding the central section and the fairing together. The smooth transition of diameter from cable to the central section via the fairings inhibits noise generation caused by prior art outer races where an abrupt change in diameter from the streamer cable to the outer race existed. Such abrupt transition can cause excessive water turbulence and signal noise as the outer race 10 moves through water with the streamer cable 5 during seismic recording operations.

The leading and trailing fairings 22, 24 are constructed of relatively compliant plastic material so as to provide softer ends to the outer race. Such softer ends are advantageous where the outer and inner races 10, 20 remain with the streamer cable 5 during cable windup, because the softer ends are less likely to damage the cable beneath. The central portion 16 is made of a strong plastic material and provides a bearing surface in cavity 12 for sliding bearing support about the exterior of cylindrical inner race 20.

What is claimed is:

1. A connector for a streamer cable which is characterized by a cable diameter and a cable longitudinal axis comprising, an inner race arranged and designed for securement about a longitudinal length of said cable and placed between a leading portion of said cable and a trailing portion of said cable, said inner race having a generally cylindrical shape with an outer diameter which is greater than said cable diameter, an outer race having, a central section of generally cylindrical shape which is arranged and designed to be rotatively supported on said inner race with an outer race central section diameter which is greater than said inner race outer diameter and having a leading end facing said leading portion of said cable and a trailing end facing said trailing portion of said cable, a leading fairing of generally frustro-conical shape characterized by a leading end of a diameter that is slightly greater than said cable diameter and a connecting end that matches said outer race central section diameter, with said connector end of said leading fairing connected to said leading end of said central section of said outer race, and a trailing fairing of generally frustro-conical shape characterized by a trailing end of a diameter that is slightly greater than said cable diameter and a connecting end that matches said outer race central section diameter, with said connecting end of said trailing fairing connected to said trailing end of said central section of said outer race.

2. The connector of claim 1 wherein said outer race is split into first and second halves, said halves being connected by a hinge along first sides of said two halves and being selectively connectable by a latching mechanism along second sides of said two halves, whereby said outer race can be opened by pivoting said halves into an open position and can be closed about said inner race by pivoting said halves into a closed position and operating said latching mechanism.

3. The connector of claim 1 wherein said central section of said outer race is fabricated of rigid material, and said leading fairing and said trailing fairing are fabricated of compliant material.

4. The connector of claim 1 wherein said inner race is cylindrical in shape, and said central section of said outer race includes a cavity which receives said inner race when said latching mechanism is closed, whereby said outer race is free to rotate about said inner race but is constrained from longitudinal movement with respect to said inner race.

* * * * *